US007775385B2

(12) United States Patent
Dudley

(10) Patent No.: US 7,775,385 B2
(45) Date of Patent: Aug. 17, 2010

(54) REMOTE-CONTROLLED MODEL RAILWAY VEHICLE COUPLING DEVICE

(76) Inventor: Curtis L. Dudley, 715 Chimney Hill La., Hockessin, DE (US) 19707

( * ) Notice: Subject to any disclaimer, the term of this patent is extended or adjusted under 35 U.S.C. 154(b) by 123 days.

(21) Appl. No.: 11/934,229

(22) Filed: Nov. 2, 2007

(65) Prior Publication Data

US 2009/0114614 A1 May 7, 2009

(51) Int. Cl.
*A63H 19/18* (2006.01)

(52) U.S. Cl. ..... 213/75 TC; 213/115

(58) Field of Classification Search ..... 213/75 TC
See application file for complete search history.

(56) References Cited

U.S. PATENT DOCUMENTS

| | | | |
|---|---|---|---|
| 138,405 | A | 4/1873 | Janney |
| 1,958,662 | A | 5/1934 | Hardman et al. |
| 1,989,804 | A | 2/1935 | Hoffer et al. |
| 2,157,187 | A | 5/1939 | Rexford |
| 2,178,016 | A | 10/1939 | Dunhill |
| 2,182,850 | A | 12/1939 | Middleton |
| 2,205,830 | A | 6/1940 | Flannery |
| 2,210,752 | A | 8/1940 | Ferri |
| 2,213,286 | A | 9/1940 | Pettit |
| 2,237,171 | A | 4/1941 | Auel |
| 2,240,137 | A | 4/1941 | Gilbert et al. |
| 2,235,555 | A | 9/1941 | Koch |
| 2,261,258 | A | 11/1941 | Kinnear |
| 2,263,959 | A | 11/1941 | Tyler |
| 2,288,792 | A | 7/1942 | Daniels |
| 2,303,731 | A | 12/1942 | Ferri |
| 2,305,134 | A | 12/1942 | Case et al. |
| 2,305,135 | A | 12/1942 | Case et al. |
| 2,574,630 | A | 11/1951 | Edwards et al. |
| 2,578,368 | A | 12/1951 | Nehrke |
| 2,594,444 | A | 4/1952 | Joyce |
| 2,631,740 | A | 3/1953 | Watson |
| 2,658,629 | A | 11/1953 | Pettit |
| 2,738,079 | A | 3/1956 | Walter |

(Continued)

FOREIGN PATENT DOCUMENTS

| | | | |
|---|---|---|---|
| DE | 3419031 | A1 | 2/1985 |

OTHER PUBLICATIONS

Ken Mortimer, RP-22 HO Coupler Pocket, NMRA Recommended Practices, Aug. 1958, Chattanooga, TN.

*Primary Examiner*—Samuel (Joe) Morano
*Assistant Examiner*—Zachary Kuhfuss

(57) ABSTRACT

An improved remote-controlled model railway vehicle coupling device comprising a coupler configured with a channeled shaft having a proximal and distal end, the proximal end forming an aperture designated for pivotably mounting within a housing, the distal end forming a head designated for limiting the pivotable displacement of a knuckle; the knuckle operable to pivot between a closed and an open position. An electronically automated locking assembly is substantially carried within the shaft of the coupler. The locking assembly includes a thermo-mechanical actuator capable of using an electric current to provide thermal energy to transpose between a martensite phase length and a shorter austenite phase length. The locking assembly further includes a bias-spring operable to both encourage the thermo-mechanical actuator towards its martensite phase length and urge the locking assembly towards the knuckle for substantial engagement with the knuckle to lock it in its closed position.

18 Claims, 14 Drawing Sheets

U.S. PATENT DOCUMENTS

| | | | | |
|---|---|---|---|---|
| 2,868,393 | A | 1/1959 | Bailey | |
| 2,872,051 | A | 2/1959 | Dunbar | |
| 2,920,770 | A | 1/1960 | Bonanno | |
| 2,933,201 | A | 4/1960 | Anderson | |
| 2,987,851 | A | 6/1961 | Bonanno | |
| 3,134,489 | A | 5/1964 | Gillham | |
| 3,150,609 | A | 9/1964 | Bradt | |
| 3,160,286 | A | 12/1964 | Wilson | |
| 3,450,271 | A | 6/1969 | Bissett | |
| 3,469,713 | A | 9/1969 | Edwards et al. | |
| 3,659,725 | A | 5/1972 | Passalacqua | |
| 3,662,489 | A | 5/1972 | Terrier | |
| 3,884,360 | A | 5/1975 | Ernst | |
| 3,939,989 | A | 2/1976 | Thomson | |
| 3,942,648 | A | 3/1976 | Edwards et al. | |
| 5,423,439 | A | 6/1995 | Richter | |
| 5,620,106 | A | 4/1997 | Storzek | |
| 5,662,229 | A | 9/1997 | Edwards | 213/75 |
| 5,775,524 | A | 7/1998 | Dunham | |
| 5,785,192 | A | 7/1998 | Dunham et al. | |
| 5,823,371 | A | 10/1998 | Riley et al. | |
| 5,826,736 | A * | 10/1998 | Weber | 213/75 A |
| 5,931,322 | A | 8/1999 | Storzek | |
| 6,095,351 | A | 8/2000 | Rossler | |
| 6,199,709 | B1 | 3/2001 | Rossler | |
| 6,308,845 | B1 | 10/2001 | Sergent, IV | |
| 6,596,102 | B2 | 7/2003 | Homma | 148/561 |
| 6,604,641 | B2 | 8/2003 | Wolf et al. | |
| 6,746,552 | B2 | 6/2004 | Homma | 148/563 |
| 6,946,040 | B2 | 9/2005 | Homma | 148/563 |
| RE38,990 | E | 2/2006 | Staat | |
| 6,994,224 | B2 | 2/2006 | Barger et al. | |
| 2009/0014402 | A1 * | 1/2009 | Wolf et al. | 213/75 TC |

* cited by examiner

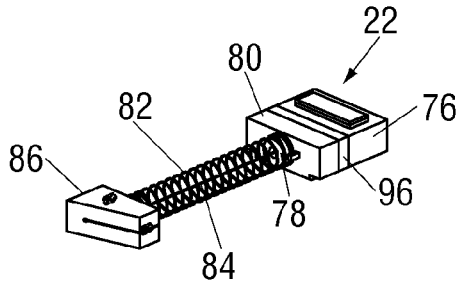
FIG. 9
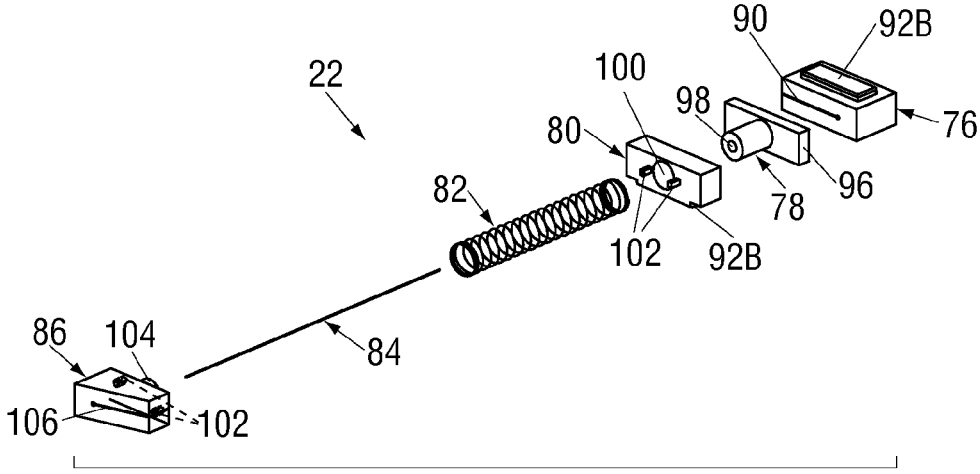
FIG. 10
FIG. 11
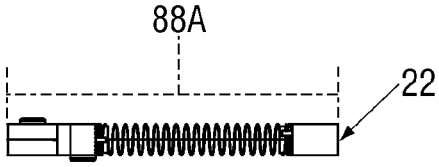
FIG. 12
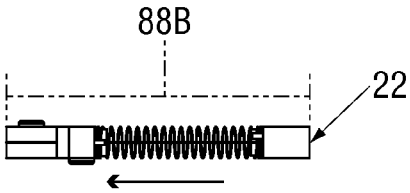

REMOTE-CONTROLLED MODEL RAILWAY VEHICLE COUPLING DEVICE

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Prior Art

This invention relates to remote-controlled scale model railway vehicle coupling devices, particularly to such devices that are automated with thermo-mechanical actuators.

2. Prior Art

Model railroading is a hobby where railroad enthusiasts endeavor to operate scale model railway vehicles in a realistic, or prototypical, manner on energized tracks arranged along a miniaturized railway system known as a layout. Several facets of model railroad operation include simulating the merchandise forwarding and delivery procedures of the prototype. These procedures generally involve connecting a number of vehicles together to form a train, maneuvering the train to a specific location on the layout, then dispatching a set number of vehicles at that location. To accomplish this, model railroad operators use vehicles equipped with coupling devices that enable any number of vehicles to either join or release, accordingly.

Most scale model railroad operators prefer vehicles equipped with "automatic" coupling devices. These devices are said to be automatic because the operator simply nudges vehicles equipped with the devices together to complete a coupling. Several types of devices are available for use by model railroad operators, including devices constructed according to U.S. Pat. No. 5,509,546 (1996) to Staat, U.S. Pat. No. 5,785,192 (1998) to Dunham et al., U.S. Pat. No. 5,823,371 (1998) to Riley et al., and U.S. Pat. No. 6,994,224 to Barger, et al. These devices generally comprise a shaft with an attachment element at one end for mounting the coupling device to a vehicle and a knuckle located at the other end of the shaft for engaging with another coupling device. The knuckle is pivotable between a closed position and an open position; the closed position is designated for joining vehicles where the knuckle is locked in position for coupled engagement with another knuckle, and the open position is designated for separating vehicles where the knuckle is unlocked so as to release the other knuckle. For uncoupling purposes, most knuckles are equipped with a ferrous metal trip-pin located on the bottom of the knuckle—such as the type disclosed in U.S. Pat. No. 5,785,192 (1998) to Dunham et al—for pivoting the knuckle towards the open position when in the proximity of an active electromagnet located beneath the tracks.

While the aforementioned prior art devices provide for a singular automatic method of coupling vehicles, operators may use either a manual or an automated method to uncouple vehicles. Generally, when using these devices operators prefer to practice a method where vehicles can be uncoupled at any number of locations along the layout to achieve a desirable prototypical operating experience.

An operator preferring the manual uncoupling method typically uses a probe-like instrument, known as an "uncoupling tool", to reach between the couplers and pivot the knuckles towards their open position. As such, the number of desirable uncoupling locations is considerably limited because the coupled vehicles must remain within reach of the operator. Structures and scenery disposed along the layout also may limit access to the coupled vehicles. Additionally, finer scale vehicles must be handled with particular care as maneuvering the uncoupling the tool while inserted between the couplers may pull the coupled vehicles out of alignment with the track, thus causing a derailment.

An operator preferring the automated uncoupling method positions the coupled vehicles over an electromagnet disposed in a specified location along the layout. The operator then sends a trigger signal to activate the electromagnet; where a magnetic field generated by the electromagnet forces the trip-pins to move laterally, causing the knuckles to pivot towards their open position. To realize a reasonable level of automation, the operator is required to install an electromagnet beneath the track at every location deemed suitable to uncouple vehicles. A secondary power supply, independent from the main power supply designated to energize the tracks for powering self-propelled vehicles, is then provided to energize the electromagnets. Next, the operator must wire circuits between the power supply and each electromagnet. Finally, activation switches must be installed along the layout for each respective electromagnet location. If the operator desires to change or add an uncoupling location, the existing electromagnet must be relocated or an additional electromagnet must be installed in the new location. It can be appreciated that automated uncoupling using the electromagnet method is comparatively burdensome to most operators who generally prefer to practice the manual uncoupling method despite its deficiencies.

U.S. Pat. No. 5,775,524 (1998) to Dunham works towards improving automated uncoupling by teaching the use of an on-board electromotive actuator assembly mechanically linked to a knuckle. Power to energize the actuator is provided by either batteries or track power conveyed through collectors, known as "pick-ups", carried aboard the vehicle. When the actuator is energized, the mechanical linkage applies a lateral force to pivot the knuckle towards its open position in the same manner as the active electromagnet influences the trip-pin.

While this device effectively eliminates the need for disposing an electromagnet at specific locations along the layout, its use is limited to vehicles that can accommodate the mechanical linkage needed to actuate the coupler. Several types of scale model locomotives are especially prohibited from using this device as vital mechanical and aesthetic components are located in the same areas needed dispose the mechanical linkage of this device.

The devices disclosed in U.S. Pat. No. 6,199,709 (2001) to Rossler and U.S. Pat. No. 6,604,641 (2003) to Wolf teach an electromagnet actuator carried entirely within the couplers' structure, energized by power conveyed through pick-ups disposed aboard the vehicle. These prior art devices provide effective means for automating the uncoupling process. However, the aggregate size of the electromagnet actuators and the couplers' structure limits their application to larger modeling scales.

Although the devices and methods described above are reasonably effective towards accomplishing prototypical operation, several limitations materialize when attempting to practice them, especially with regard to automated uncoupling devices and methods. Thus, all prior art devices heretofore known suffer from either one or all of these disadvantages:

- Prior art devices hinder prototypical operation by requiring model railroad operators to position vehicles near an electromagnet or within reach of the operator to perform an automated uncoupling. Conversely, prototype railroad operators are generally able to uncouple vehicles at any point along the railway. The extraneous maneuvers required for model railroad operators to perform an uncoupling are not consistent with prototypical operation and considerably limit the number of locations available for remotely uncoupling vehicles.
- Operators preferring prior art automated uncoupling methods must install electromagnet uncoupling devices beneath the track of their layout at numerous locations to realize a desirable level of automation. This requires providing additional power supplies, wiring, and activation switches for each respective electromagnet uncoupling device installed on the model railway layout.
- Prior art devices teaching carrying electromechanically actuated coupling devices within the railway vehicle generally comprise components that generally interfere with vital mechanical and aesthetic components located aboard most scale model railway vehicles, including various scale locomotives.
- Prior art devices teaching carrying electromagnetically actuators within the couplers' structure generally comprise components that are constructed in such a large size that they are unsuitable for application to finer scale model railway vehicles.

OBJECTS AND ADVANTAGES

Accordingly, several objects and advantages of the present invention are:

- To provide a remote-controlled coupling device that enables a model railroad operator to use conventional electronic command and control devices, such as Digital Command Control (DCC) devices, in combination with the present invention to remotely uncouple railway vehicles from a train at any desirable location along a model railway.
- To provide a remote-controlled coupling device using actuating componentry of a size that permits the device to be applicable to most scale model railway vehicles, including scale model railway locomotives and vehicles constructed in finer scales.
- To provide a remote-controlled coupling device that permits ready access to sub-componentry for maintenance or replacement, particularly the locking assembly which is essentially self-contained. This advantage enables the locking assembly to be mass-produced and available during manufacture or later replacement. It also extends the useful life of the present invention by allowing operators to replace the component instead of replacing the entire device.

Further objects and advantages will become apparent from a consideration of the ensuing description and drawings.

SUMMARY

In accordance with the present invention, a remote-controlled model railway vehicle coupling device comprises an electronically automated locking assembly carried within a coupler having a knuckle arranged to pivot between an open and a closed position. The locking assembly is disposed within the coupler and arranged such that the proximal end of the locking assembly is permitted to suitably project from the bottom and top of the coupler, while the distal end of the locking assembly is operable to lock the knuckle in its closed position. When the locking assembly is activated, it retracts to disengage the knuckle, allowing the knuckle to pivot towards its open position. Accordingly, the knuckle is configured with a compression spring operable to rotate the knuckle towards its open position when disengaged from the locking assembly. A housing is provided for both receiving the proximal end of the coupler and mounting the present invention along a scale model railroad vehicle. A pair of wipers disposed along the housing are provided to communicate an electric current conveyed from energized tracks, to a conventional electronic command device carried aboard the scale model railroad vehicle, and then to the locking assembly. The wipers are configured to both contact the proximal end of the locking assembly as it protracts from the coupler and to protract from the housing to connect with the conventional electronic command device.

DRAWINGS

Figures

All closely related figures have the same number but different alphabetic or alphanumeric suffixes.

FIG. 9 is a perspective view of a locking assembly constructed according to the present invention;

FIG. 10 is an exploded view of the locking assembly illustrated in FIG. 9;

FIG. 11 is a side view of the locking assembly illustrated in FIG. 9, depicting the locking assembly in its first length;

FIG. 12 is a side view of the locking assembly illustrated in FIG. 9, depicting the locking assembly in its second length;

DETAILED DESCRIPTION

Preferred Embodiment

Figure 1:
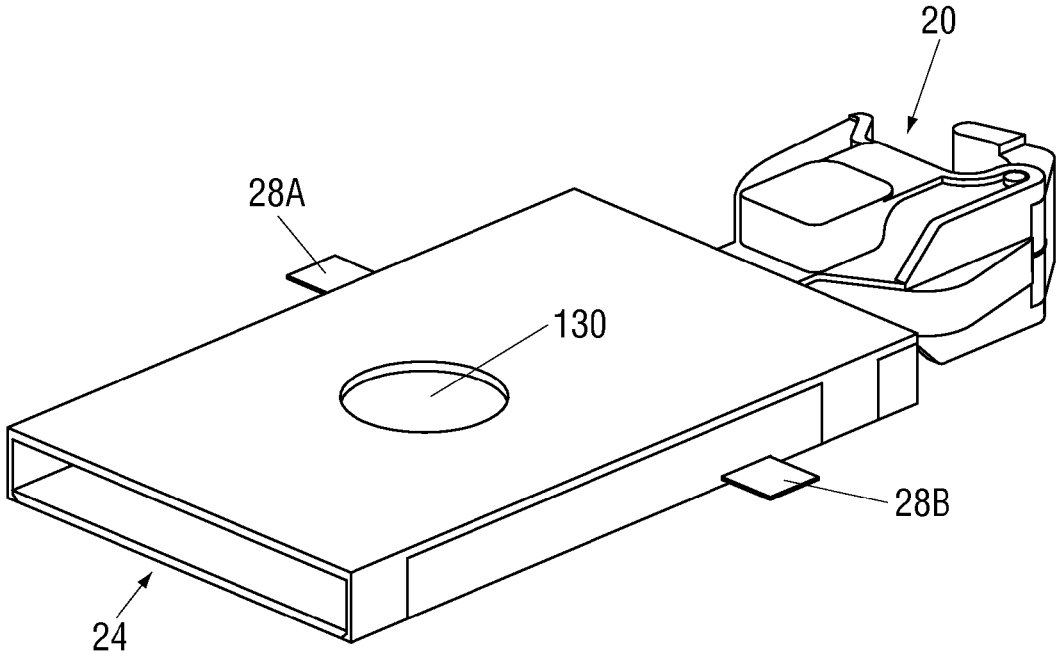
FIG. 1 is a perspective view of a preferred embodiment of a remote-controlled model railway vehicle coupling device constructed according to the present invention.

Referring to FIGS. 1 through 4, the device constructed according to the present invention generally comprises a coupler 20, an electronically automated locking assembly 22, and a housing 24. Coupler 20 is arranged to receive locking assembly 22 therein while housing 24 is arranged to carry coupler 20 for mounting aboard a model railway vehicle. A knuckle 26 is pivotably mounted along the distal end of coupler 20 and operable to reliably pivot between an open or closed position. The distal end of locking assembly 22 is located adjacent to the proximal end of knuckle 26 so as to substantially engage knuckle 26 in its closed position. When activated, locking assembly 22 is operable to summarily contract from its engagement position with the proximal end of knuckle 26 to allow knuckle 26 to freely pivot towards its open position. A pair of wipers 28A, 28B, located along housing 24 and arranged to slidably engage coupler 20, are operable to communicate an electric current between locking assembly 22, a conventional electronic command device 30 disposed aboard the model railway vehicle, and a conventional electronic power supply 32 provided to energize track arranged along a model railroad layout.

Figure 3:
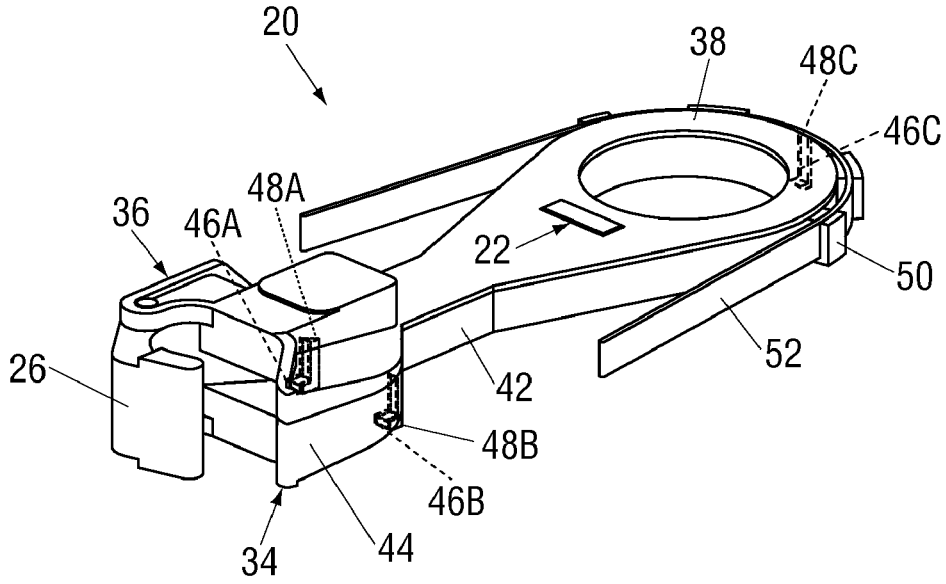
FIG. 3 is a perspective view of a coupler constructed according to the present invention.

As shown in FIG. 3, coupler 20—preferably made of a zinc alloy treated with a non-conductive coating or engineering plastic—comprises two interconnected, cooperating elements to define a bottom member 34 and a top member 36. Bottom member 34 is chiefly designated to carry locking assembly 22 therein, while top member 36 is designated to cover bottom member 34.

Continuing with FIG. 3, bottom member 34 and top member 36 are presently interconnected and cooperating to comprise coupler 20. An aperture 38, defining the proximal end of coupler 20, is arranged to pivotably engage a boss 40 (FIG. 2) disposed substantially near the proximal end of housing 24. An elongated, tapered shaft 42, defining the center portion of coupler 20, is formed of an apt thickness and width to both substantially receive locking assembly 22 and freely pivot within housing 24. A partial enclosure forming a head 44, formed substantially thicker and wider with respect to shaft 42, is disposed along the distal end of shaft 42 to pivotably carry knuckle 26.

Figure 4:
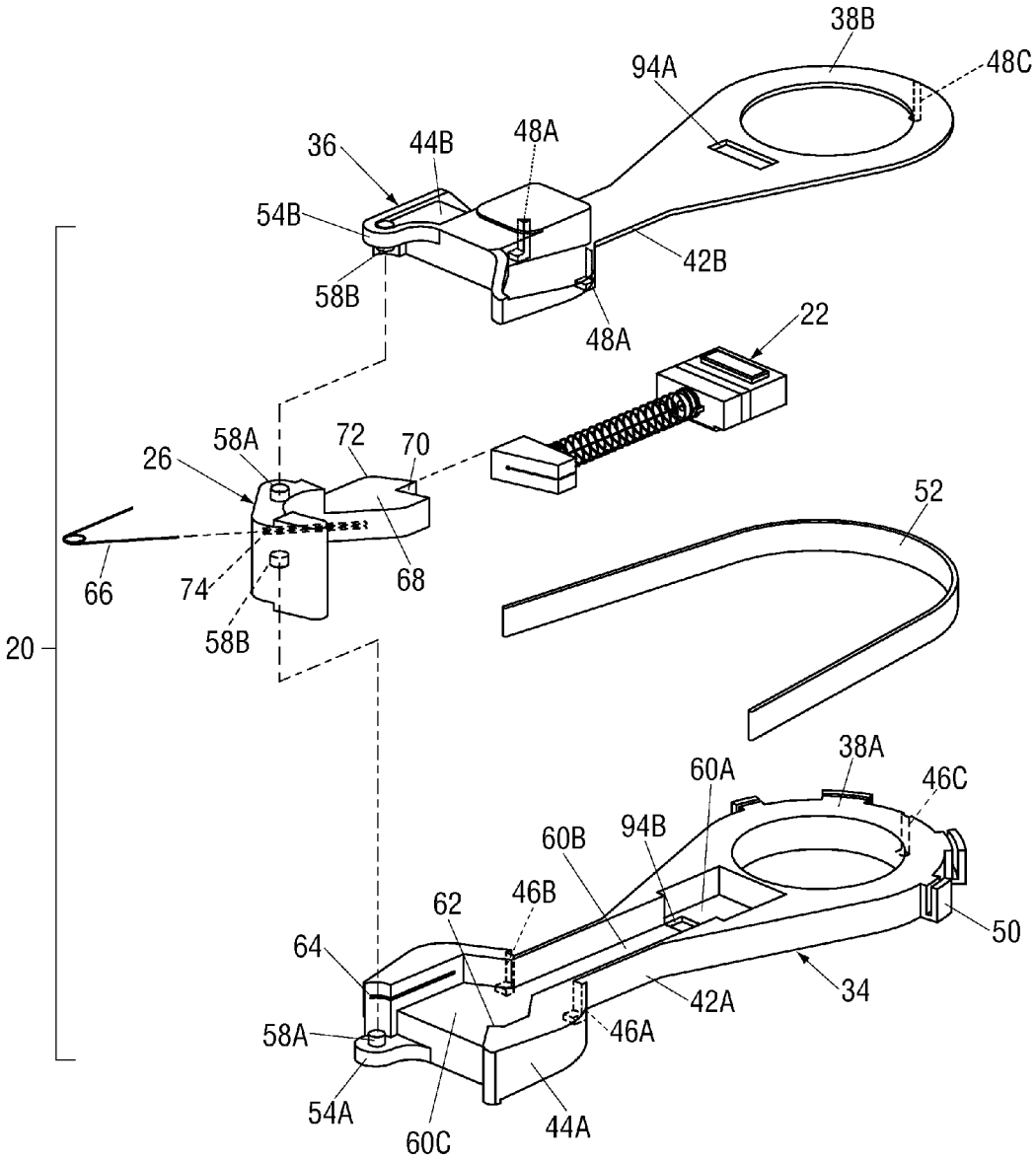
FIG. 4 is an exploded view of the coupler illustrated in FIG. 3.
Figure 5:
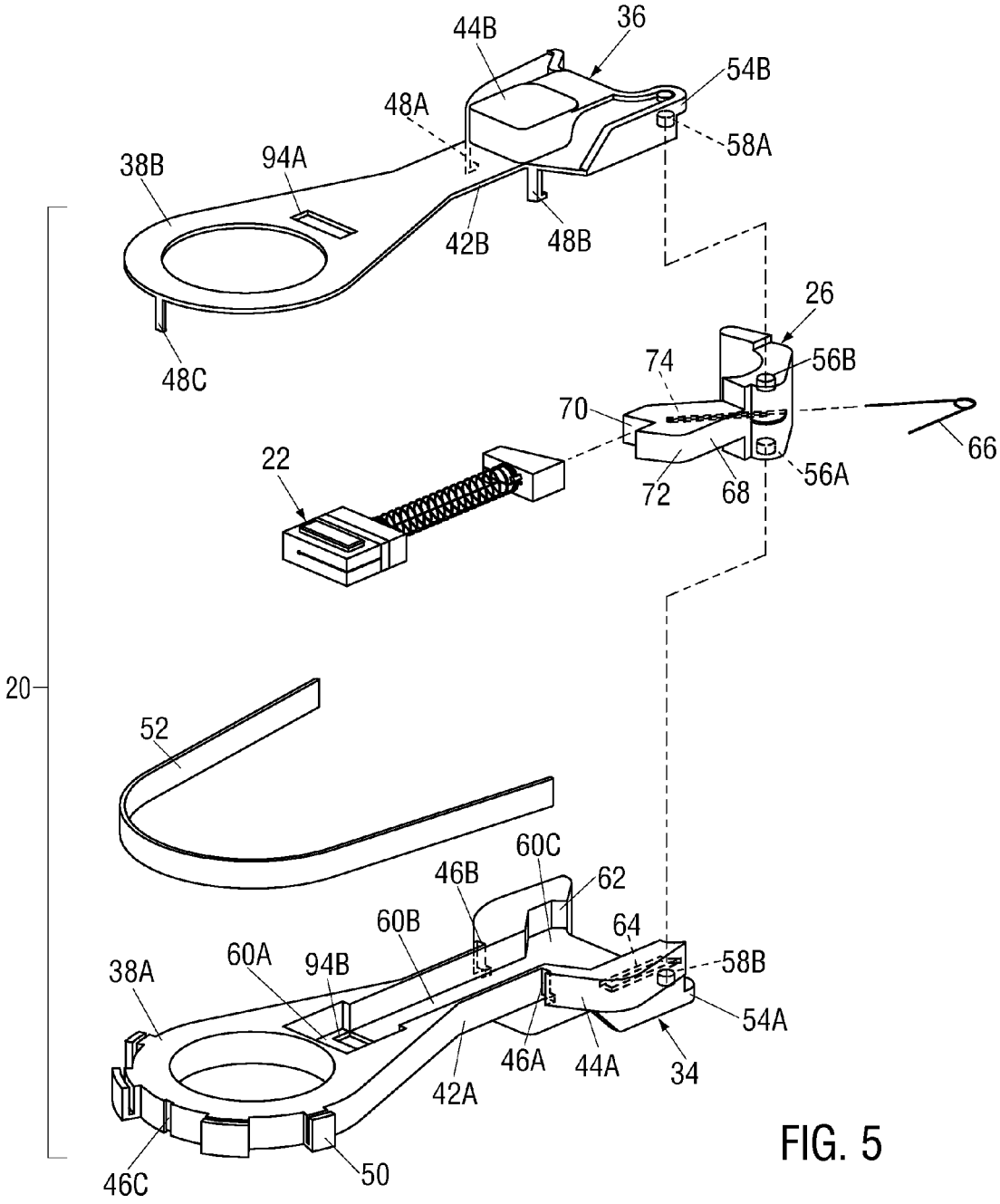
FIG. 5 is an exploded, alternate perspective view of the coupler illustrated in FIG. 3.

Referring now to FIGS. 4 and 5, bottom member 34 and top member 36 are presently disconnected to illustrate their respective lower and upper configurations to further define aperture 38, shaft 42, and head 44. Accordingly, bottom member 34 includes a lower-aperture 38A, a lower-shaft 42A, and a lower-head 44A; while top member 36 includes an upper-aperture 38B, an upper-shaft 42B, and an upper-head 44B.

A set of suitably shaped gains 46A, 46B, 46C and corresponding hooks 48A, 48B, 48C are configured to cooperate for secure engagement when bottom member 34 and top member 36 are interconnected. Gain 46A is located along the proximal end of lower-aperture 38A and registered to accept hook 48A, located along the proximal end of upper-aperture 38B. Gains 46B, 46C are located proximally along the left and right sides of lower-head 44A and registered to receive hooks 48B, 48C, correspondingly located along the left and right proximal ends of upper-head 44B. It should be understood that hooks 48A, 48B, 48C are formed substantially thinner than top-member 36 to allow ample inflection when engaging gains 46A, 46B, 46C.

A cradle 50 is configured along the proximal end of lower-aperture 38A and designated to pressingly receive a centering spring 52. Centering spring 52—preferably formed of an engineering plastic—is an A-shaped compression spring configured to provide an equilibrate force operable to center coupler 20 within housing 24 following incidental rotational displacement. As bottom member 34 is chiefly designated to receive locking assembly 22, lower-shaft 42A is formed of an apt thickness and width to entirely receive locking assembly 22. Lower-head 44A is configured with an extension disposed along its distal end to define a lower-lobe 54A arranged to partially receive knuckle 26. A socket 56A is centrally located along lower-lobe 54A to pivotably receive a pivot-pin 58A correspondingly located along the bottom of knuckle 26.

Figure 6:
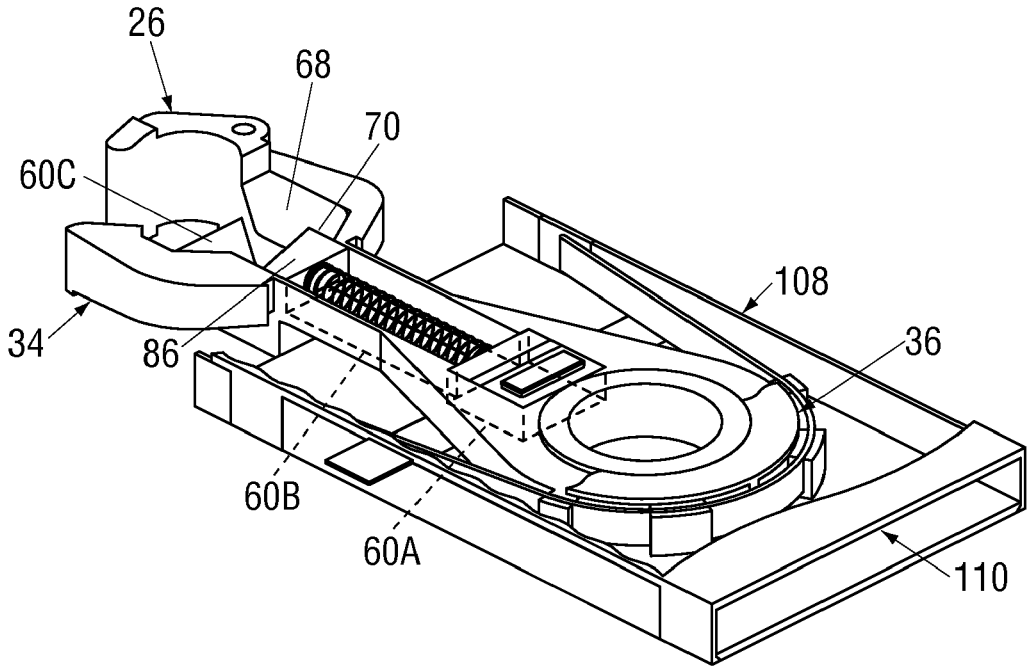
FIG. 6 is a fragmentary, alternate perspective view of the remote-controlled model railway vehicle coupling device illustrated in FIG. 1.

Lower-shaft 42A is further configured with a pair of channels 60A, 60B disposed contiguously from its proximal end towards the proximal end of lower-head 44A. As shown in FIG. 6, channels 60A, 60B are formed of a uniform depth concurrent with locking assembly 22 as it is received therein. However, channel 60A is noticeably wider than channel 60B as channel 60A is designated to fittingly receive the proximal elements of locking assembly 22, while channel 60B is designated to slidingly receive the distal elements of locking assembly 22, as described hereinafter.

Returning to FIGS. 4 and 5, lower-head 44A is further configured with a channel 60C, formed concurrent with the depth of channels 60A, 60B, disposed adjacently to the distal end of channel 60B, and arranged to accept the pivotable range of knuckle 26. Accordingly, a stop 62 is configured distally along the left side of channel 60C to limit the pivotable range of knuckle 26, while a slot 64 is configured distally along the right side of channel 60C to receive a left portion of a spring 66 disposed along knuckle 26. Spring 66—preferably made of spring-steel—is an A-shaped compression spring operable to summarily encourage knuckle 26 towards stop 62 after locking assembly 22 contracts from its abutment position; thereby entirely placing knuckle 26 in its open position.

As depicted in FIGS. 4 and 5, upper-aperture 38B, upper-shaft 42B, and upper-head 44B are substantially thinner in cross-section than their corresponding lower elements comprising bottom member 34. Upper-head 44B is configured with an extension disposed along its right distal end to define an upper-lobe 54B arranged to partially receive knuckle 26. A socket 56B is centrally located along upper-lobe 54B to pivotably receive a pivot-pin 58B correspondingly located along the top of knuckle 26.

Figure 7:
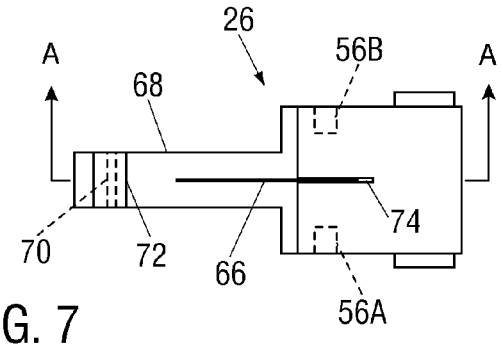
FIG. 7 is a side view of a knuckle constructed according to the present invention.
Figure 8:
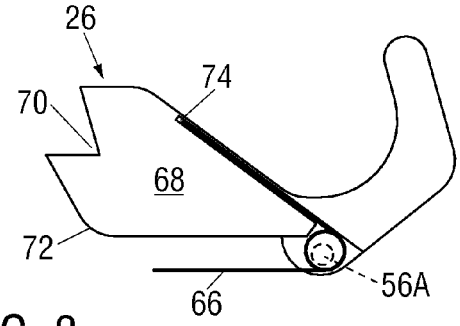
FIG. 8 is a sectional view of the knuckle illustrated in FIG. 7 taken along lines A-A.

Referring now to FIGS. 7 and 8, knuckle 26 is further configured with an extension shaped to be received within channel 60C to define an arm 68 operable to engage the distal end of locking assembly 22. Accordingly, a notch 70 is located in the proximal end of arm 68 to receive locking assembly 22, accordingly. A contour 72, disposed adjacently to notch 70, is configured to slidingly contact locking assembly 22 to permit apposite engagement with notch 70, as described hereinafter. A void 74, disposed through the center of knuckle 26, is provided to receive the right branch of spring 66.

Referring now to FIGS. 9 and 10, locking assembly 22 is provided as a component assembly comprising a crimp 76, sleeve 78, contact 80, bias-spring 82, actuator 84, and crimp-pin 86. Crimp 76 and crimp-pin 86 are each arranged to retain actuator 84 along its proximal and distal ends, respectively; while sleeve 78, contact 80, and bias-spring 82 are each disposed along actuator 84. Crimp 76, sleeve 78, and contact 80 define the proximal elements of locking assembly 22, where each are configured to snugly fit entirely within channel 60A. Thus, crimp 76 is disposed in the proximal end of channel 60A, sleeve 78 is disposed adjacently to crimp 76 within the center of channel 60A, and contact 80 is disposed adjacently to sleeve 78 within the distal end of channel 60A. Bias-spring 82 and crimp-pin are each configured to slidingly fit within channel 60B. Crimp-pin 86 defines the distal end of locking assembly 22 and, as such, chiefly designated for engaging notch 70 while knuckle 26 is disposed in its closed position.

Figure 17A:
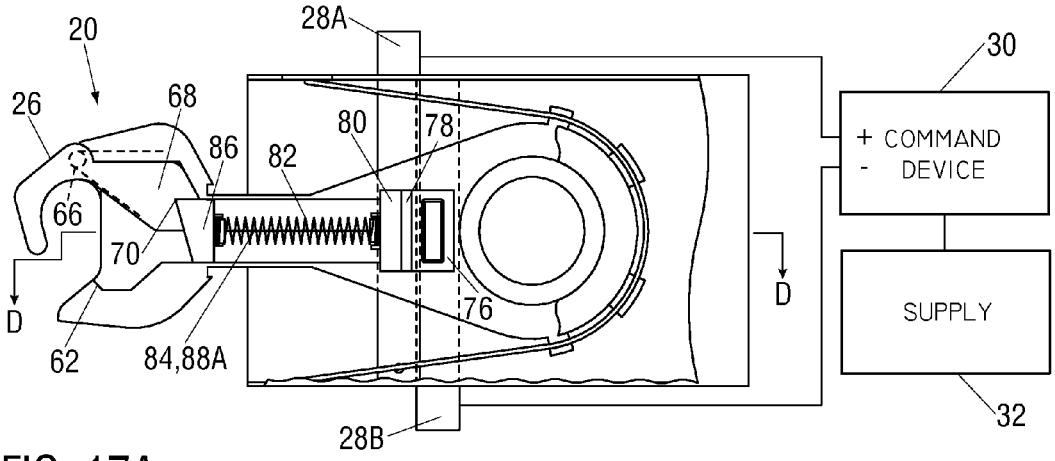
FIGS. 17A-17D are fragmentary, plan views of the remote-controlled model railway vehicle coupling device illustrated in FIG. 14, depicting the device in various modes of operation.

As shown in FIGS. 11 and 12, locking assembly 22 is operable to move between a nominal first-length 88A and substantially contracted second-length 88B, as indicated by the arrow; where, as best shown in FIG. 17A, bias-spring 82, actuator 84, and crimp-pin 86 are drawn aft within channel 60B, while crimp 76, sleeve 78, and contact 80 remain stationary within channel 60A.

Referring again to FIGS. 9 and 10, crimp 76 is a cuboid-shaped element preferably made of a conductive metal alloy such as brass or bronze. A horizontal groove 90 is further configured through the center of crimp 76 and arranged to receive the proximal end of actuator 84. Thus, actuator 84 is inserted into groove 90 and aligned with the center of crimp 76. Crimp 76 is then compressed to close groove 90; thereby securing actuator 84 in its present position. A suitable amount of adhesive may be added to groove 90 to further secure actuator 84. A rectangular contact-pad 92A is further configured integrally along the top of crimp 76.

Figure 13:
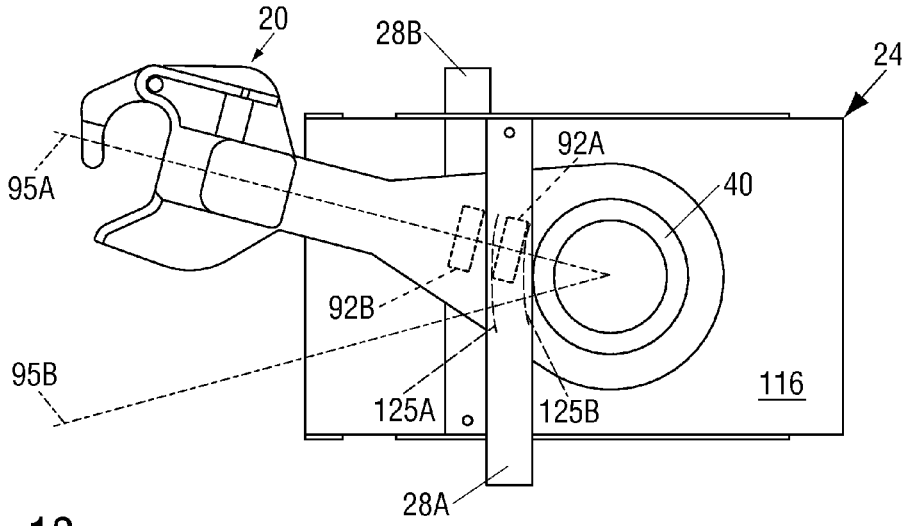
FIG. 13 is a simplified plan view of the remote-controlled model railway vehicle coupling device illustrated in FIG. 1, depicting the coupler, contact pads, and wipers interacting within the housing.
Figure 18A:
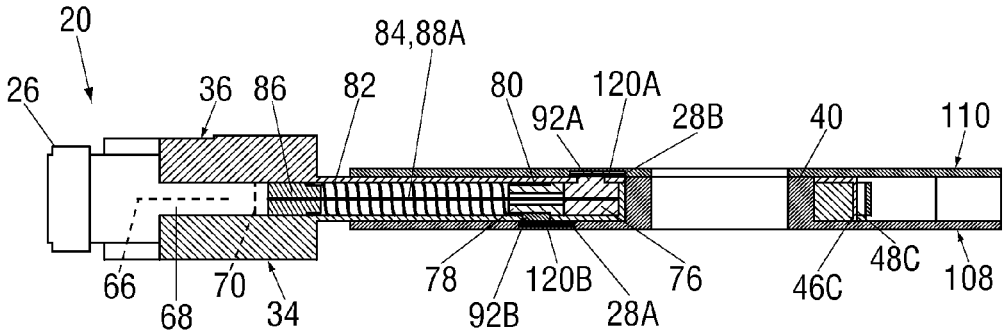
FIG. 18A is a sectional view of the remote-controlled model railway vehicle coupling device illustrated in FIG. 17A taken along lines D-D.
Figure 18B:
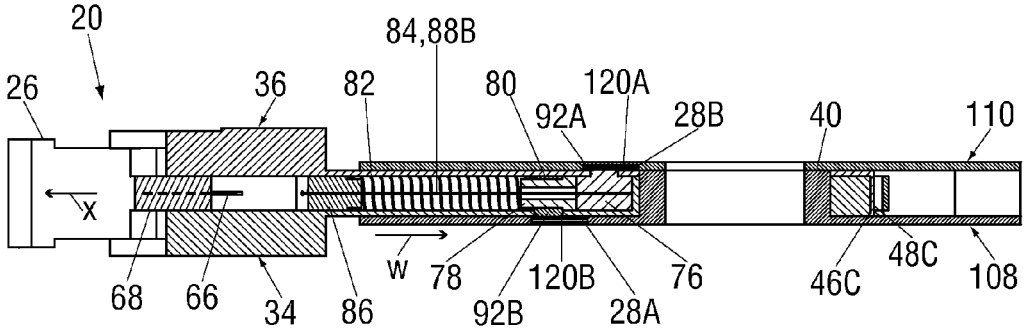
FIG. 18B is a sectional view of the remote-controlled model railway vehicle coupling device illustrated in FIG. 17B taken along lines E-E.

As shown in FIGS. 18A and 18B, contact-pad 92A is formed of a suitable thickness to slightly pass through a corresponding outlet 94A, further configured in upper-shaft 42B, and slidingly engage wiper 28A. As shown in FIG. 13, contact pad 92A is further formed to substantially contact wiper 28A throughout the lateral range of coupler 20, defined by lines 95A, 95B, as it pivots about boss 40.

Referring again to FIGS. 9 and 10, sleeve 78 is a tube-shaped element—preferably made of engineering plastic—formed of a suitable diameter and length to both fittingly accept the proximal end of bias-spring 82 and pass substantially through contact 80. Sleeve 78 is further configured integrally with a rectangular flange 96 disposed along its proximal end and formed of a suitable shape to both fit adjacently to crimp 76 and prohibit contact between crimp 76 and contact 80. A lumen 98 is further configured through the center of sleeve 78 and formed of an ample diameter to permit actuator 84 to entirely pass through and engage crimp 76 accordingly.

Contact 80 is a cuboid-shaped element preferably made of a conductive metal alloy such as brass or bronze. Contact 80 is further configured integrally with a contact-pad 90B formed and operable similarly to contact-pad 9BA but disposed along the bottom of contact 80. An outlet 94B is correspondingly provided in channel 60A to allow contact-pad 92B to slightly pass through and slidingly engage wiper 28B (FIGS. 18A and 18B). A bore 100, formed of a suitable diameter to fittingly receive sleeve 78, is further configured through the center of contact 80. A first pair of snubs 102 are further configured along the distal vertical face of contact 80 and arranged to fittingly receive bias-spring 82 as it is disposed about sleeve 78.

Bias-spring 82 is coil compression spring—preferably made of a conductive metal alloy such as brass or bronze—formed of a diameter and length to fit about the respective distal and proximal ends of sleeve 78 and crimp-pin 86, accordingly. Bias-spring 82 is operable to exert a biasing force to equilibrate the force of actuator 84 as it reverts to its nominal length, as described hereinafter. Bias-spring 82 is further operable to provide an urging force to encourage crimp-pin 86 towards its engagement position within notch 70.

Actuator 84 is a linear thermo-mechanical micro-coil manufactured and marketed by Told Corporation as Bio-Metal® Helix (BMX 150 Series) that features use anisotropic properties which it is capable of operating within a vastly superior kinetic ("SMA") actuators; wherein it is capable of operating within a vastly superior kinetic displacement range than conventional SMA actuators (See U.S. Pat. Nos. 6,596,102 (2003), 6,746,552 (2004), and 6,946,040 (2005) to Homma). Actuator 84 is a linear thermo-mechanical micro-coil having transposable martensite and austenite phase lengths; whereby it is configured to summarily contract towards its predetermined austenite phase length when heated through its transition temperature and then gradually protract towards its predetermined martensite phase length when cooled. As actuator 84 is made a of a nickel-titanium alloy with poor electrical conductivity properties, it can be heated by means of thermal resistance as an electric current is passed through it. Thus, actuator 84 is arranged as a thermo-mechanical actuator energized by an electric current provided by power supply 32 and administered through command device 30. Further, if a biasing force is applied to encourage actuator 84 from its austenite phase length towards its martensite phase length during cooling, it will protract in such a manner that it can be reliably operable to reciprocate for tens of thousands of cycles during its service life. It should be understood that actuator 84 generates a substantial contracting force during transposition to its austenite phase length, such that the contracting force is substantial to overcome the biasing force. Conversely, as actuator 84 transposes towards its martensite phase length, it becomes characteristically malleable; such that the biasing force is suitable to encourage it towards its martensite phase length.

According to the present invention, the martensite phase length and austenite phase length of actuator 84 are configured to respectively define the first-length 88A and second-length 88B of locking assembly 22; where the exemplary first-length 88A is approximately 6 mm, while the exemplary second-length 88B is approximately 4 mm, as generally depicted in FIGS. 11 and 12. It should be understood that first-length 88A is 150% of second-length 88B, as it is desirable for actuator 84 to remain within its manufacturer recommended kinetic displacement range of 100%-200% to remain reliably transposable throughout its service life. While the preferred embodiment actuator 84 is configured in the exemplary lengths, it should be understood that the actuator may be configured in various lengths corresponding to the length of coupler shaft, provided that the kinetic displacement range is used a guideline to determine a requisite contraction length.

Crimp-pin 86 is a wedge-shaped element—preferably made of a conductive metal alloy such as brass or bronze—formed suitably to both substantially engage notch 70 and slidingly contact channel 60C such that there is no undue binding while moving fore and aft, accordingly. Crimp-pin 86 is further configured with a post 104 formed suitably to fittingly receive the distal end of bias-spring 82. A second pair of snubs 102 are further configured along the proximal vertical face of crimp-pin 86 and arranged to fittingly receive bias-spring 82 as it is disposed about post 104. A horizontal groove 106 is provided through the center of crimp-pin 86 designated for receiving the distal end actuator 84. Accordingly, actuator 84 is inserted into slot 64 and aligned with the center of crimp-pin 86. Crimp-pin 86 is then compressed to close groove 106; thereby securing actuator 84 in its present position. A suitable amount of adhesive may be added to groove 106 to further secure actuator 84 accordingly.

Referring again to FIGS. 1 and 2, housing 24 is provided as an element—preferably made of engineering plastic—comprising two interconnected elements defining a partial housing 108 and a cover 110; each respectively configured with cooperating holds 112 and tabs 114 provided for securely engaging cover 110 to partial housing 108.

Partial housing 108 is further configured with a base 116 formed integrally with a pair of walls 118A, 118B located along its left and right sides and formed substantially to define the thickness of housing 24 such that coupler 22 is received with no undue binding when pivotably displaced therein. The aforementioned boss 40, formed of a diameter suitable for pivotably receiving aperture 38, is further configured integrally along base 116, accordingly.

Figure 2:
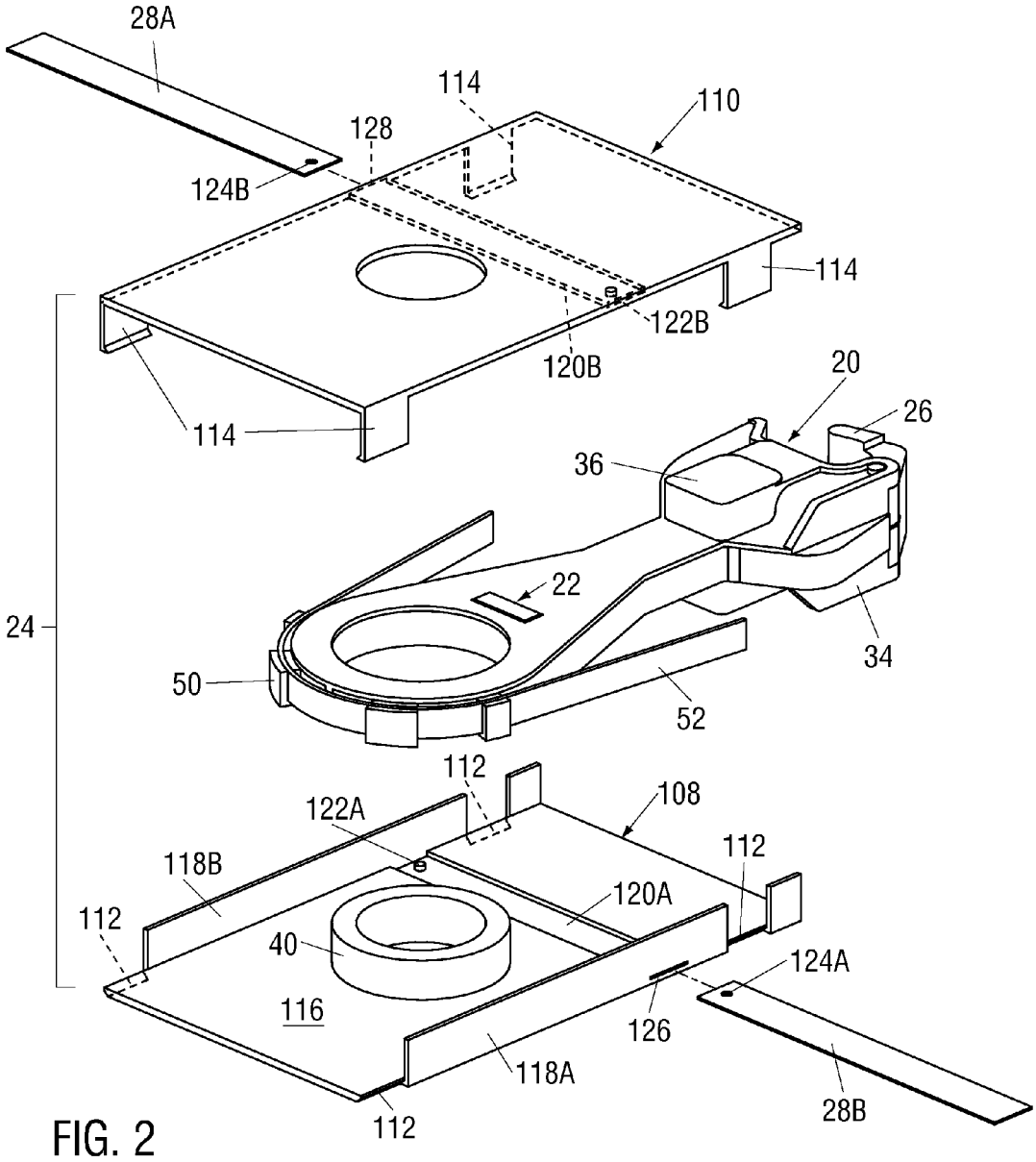
FIG. 2 is an exploded view of the remote-controlled model railway vehicle coupling device illustrated in FIG. 1.

As best shown in FIG. 2, base 116 is further configured with a shallow, rectangular recess located along its distal end and situated across its width to define a cavity 120B arranged to substantially receive wiper 28B; whereby the depth of cavity 120B is suitable to permit ample inflection of wiper 28B as it operably interacts with contact-pad 90B, as best shown in FIGS. 18A and 18B. A circular pin 122B, extending vertically to a height concurrent with surface of base 116, is located substantially near the left side of cavity 120B and arranged to fittingly receive a pin-hole 124B correspondingly located along wiper 28B. Circular pin 122B is operable to prohibit lateral displacement of wiper 28B as it is disposed within cavity 120B.

Wall 118B is further configured with a horizontal opening approximating the cross-section of wiper 28B (FIG. 18A) to define a slit 126, disposed so as to align contiguously with the cross-section of cavity 120B and wiper 28B as it is carried within partial housing 108.

Like base 116, cover 110 is further configured with a cavity 120A formed similarly to cavity 120B in that it is a rectangular recess located along the distal end of cover 110, situated across its width, and arranged to substantially receive wiper 28A. A circular pin 122A, formed similarly to pin 122B, is disposed substantially near the right side of cavity 120A, and arranged to fittingly receive pin-hole 124A correspondingly located along wiper 28A. As shown in FIG. 4, cover 110 is further configured with a horizontal opening formed correspondingly with the left side of cavity 120A to define a notch 128 arranged to receive wiper 28A.

As shown in FIG. 13, wipers 28A, 28B—preferably made of a conductive metal alloy such as brass or bronze—are further configured as rectangular elements formed of a width suitable for entirely receiving the operable range of contact pads 92A, 92B as they pivot with coupler 20, as defined by lines 125A, 125B. Further, wipers 28A, 28B protract a suitable distance outwards from slit 126 and notch 128, respectively. Further, wipers 28A, 28B are formed of a suitable thickness for ample inflection when interacting with contact-pads 92A, 92B. It should be understood that although wipers 28A, 28B are depicted as protracting uniformly from housing 24, their shape may be altered to fit accordingly along the model railway vehicle.

As presently constructed, housing 24 is readily configurable to attach to the model railroad vehicle through conventional means; where, for example, a fastener (not shown) is provided to pass through a hole 130 (FIG. 1) further configured through boss 40 and attached to the vehicle, or where housing 24 is adhered to the vehicle by gluing.

It should be further understood that the device constructed according to the present invention may use various conventional power supplies; including, as preferred by the preferred embodiment, electricity traveling through model railroad track and harnessed through pick-up means disposed along the model railroad vehicle, or a battery disposed aboard the model railroad vehicle. Additionally, various conventional command device means may be used to relay a trigger signal from an operator to the present invention; including, for example, a Digital Command Control (DCC) remote-control device communicating the trigger signal through the track to a DCC decoder disposed aboard the model railroad vehicle or a radio transmitter communicating the trigger signal to a receiver disposed aboard the model railroad vehicle.

Operation

Figure 14:
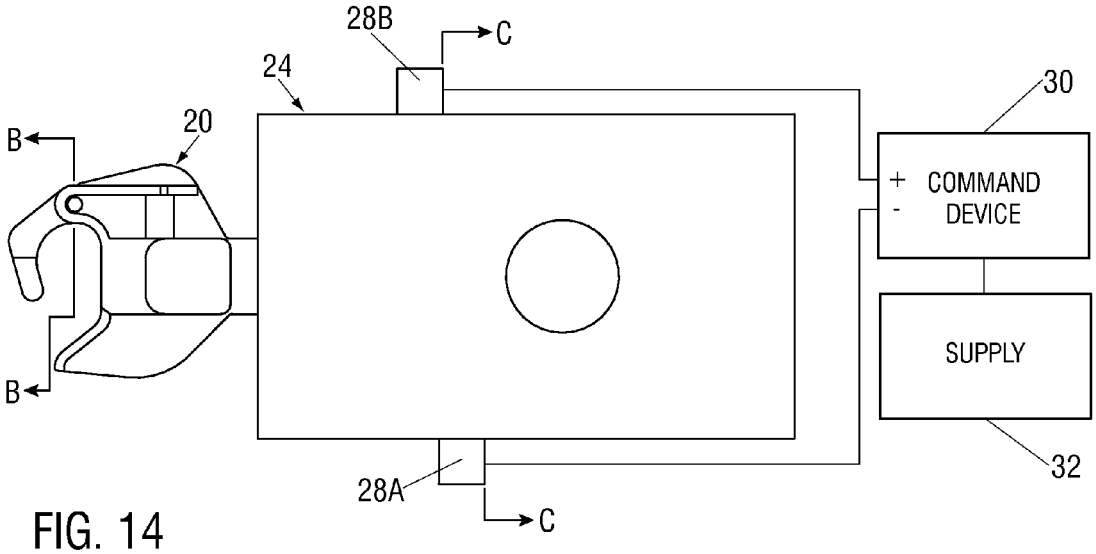
FIG. 14 is a plan view of the remote-controlled model railway vehicle coupling device illustrated in FIG. 1, depicting the device connected to a conventional command device and power supply.
Figure 15:
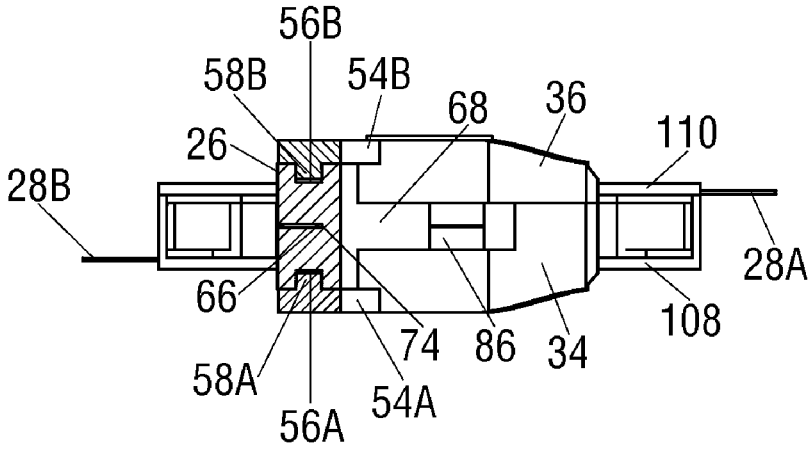
FIG. 15 is a sectional view of the remote-controlled model railway vehicle coupling device illustrated in FIG. 14 taken along lines B-B.
Figure 16:
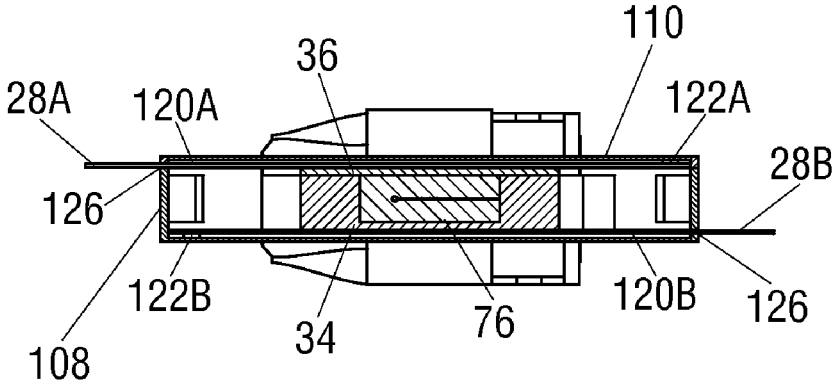
FIG. 16 is a sectional view of the remote-controlled model railway vehicle coupling device illustrated in FIG. 14 taken along lines C-C.

Referring now to FIG. 14, to accomplish operation of the present invention, it should be understood by those skilled in the art that command device 30 is connected conventionally to wipers 28A, 28B then suitably configured to administer an electric current equivalent to 150 mA for conveyance to locking assembly 22; where power supply 32—preferably DCC track power collected through conventional pick-up means (not shown) and conveyed to command device 30—is generally rated between 5-6 A, 12-15 VAC and command device 30 is configurable to accept said power rating. Further, wipers 28A, 28B are understood to be arranged to effectuate a closed-loop circuit; whereby, for example, wiper 28A is arranged as a positive pole while wiper 28B is arranged as a negative pole.

Thus, as shown in FIGS. 17A and 18A, a preferred embodiment constructed according to the present invention is depicted in what is said to be an entirely closed condition.

Figure 17B:
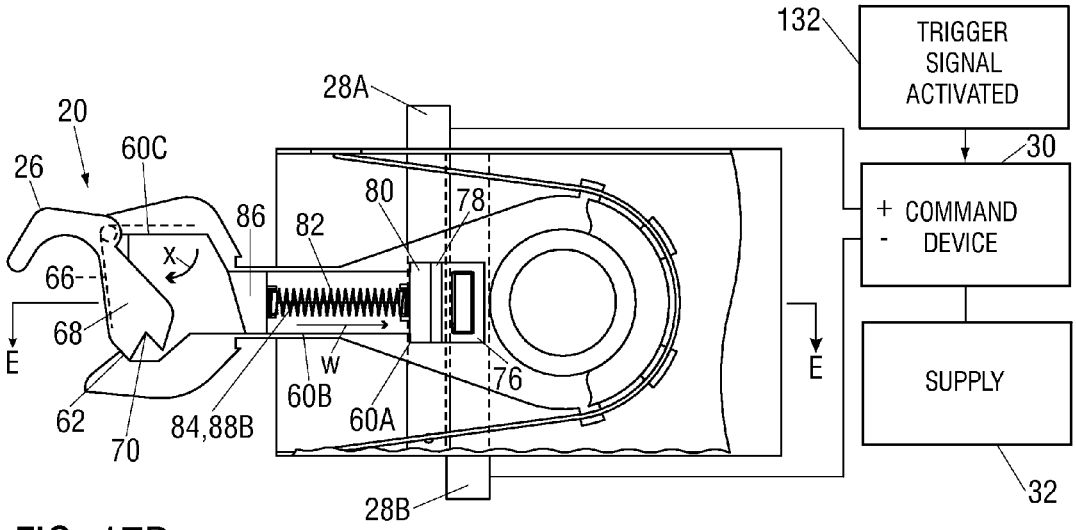

Turning now to FIGS. 17B and 18B, following the activation of a trigger signal 132, an electric current generated from power supply 32 and administered through command device 30 is conveyed through wiper 28A, conductive crimp 76, and contact 80, respectively. As non-conductive sleeve 78 is operable to insulate crimp 76 from contact 80, the current appositely passes through crimp 76 to electrically resistive actuator 84; thereby heating actuator 84 through its transition temperature. The current then passes through conductive crimp-pin 86, bias-spring 82, contact 80, and wiper 28B. While channel 60A operably retains crimp 76, sleeve 78, and contact 80 in their present position, crimp-pin 86 disengages from notch 70 and is drawn aft within channel 60B as actuator 84 contracts from first-length 88A towards second-length 88B (as indicated by arrow w). As arm 68 is presently free to pivotably rotate within channel 60C, spring 66 summarily rotates knuckle 26 towards stop 62 (as indicated by arrow x).

Coupler 20 is now said to be in an open condition and may freely uncouple from its coupling-mate (not shown).

Figure 17C:
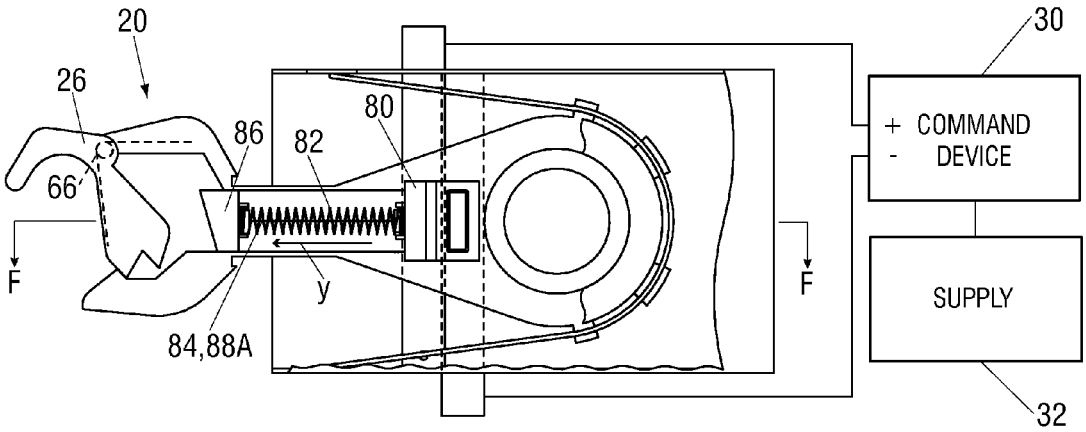
Figure 17D:
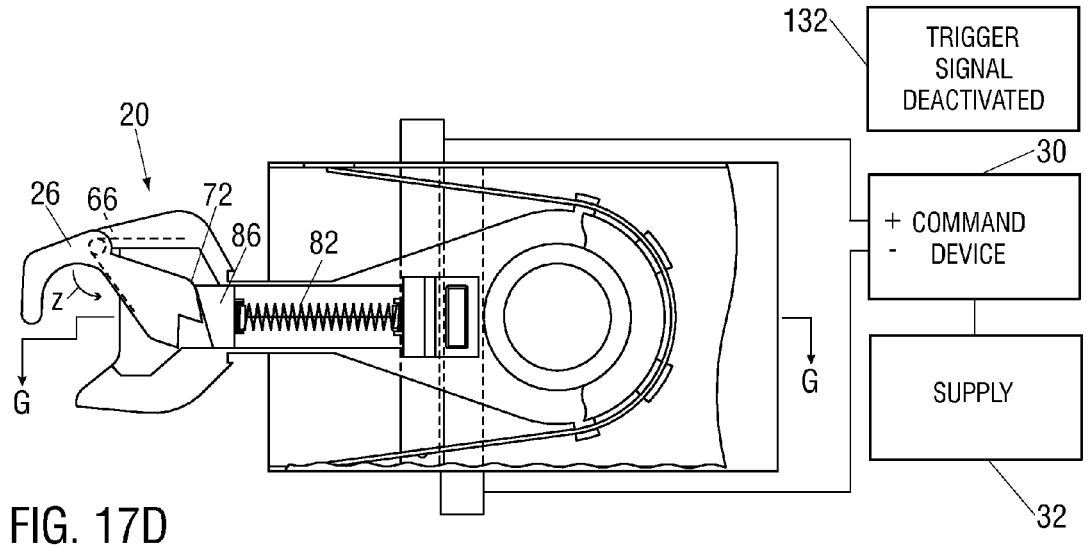
Figure 18C:
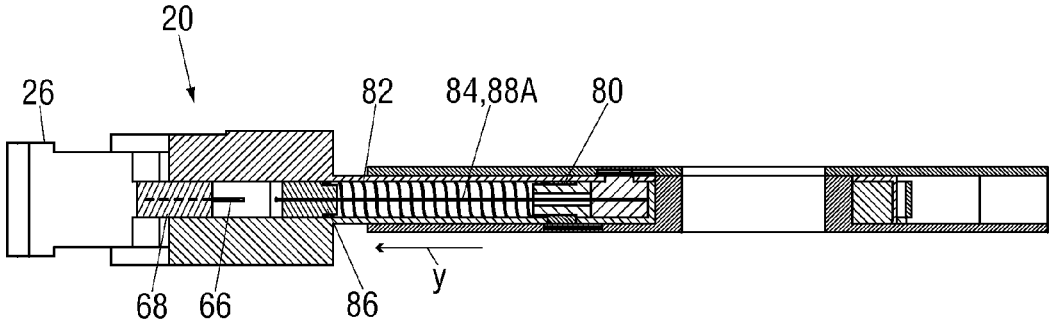
FIG. 18C is a sectional view of the remote-controlled model railway vehicle coupling device illustrated in FIG. 17C taken along lines F-F.
Figure 18D:
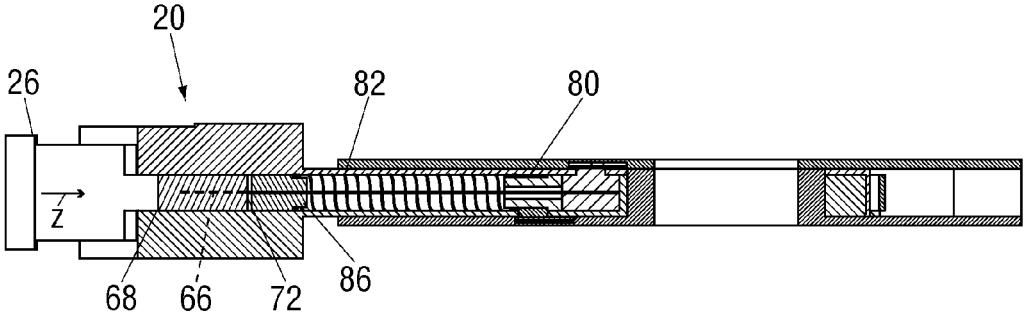
FIG. 18D is a sectional view of the remote-controlled model railway vehicle coupling device illustrated in FIG. 17D taken along lines G-G.

Turning now to FIGS. 17C and 18C, when trigger signal 132 is deactivated and actuator 84 begins to transpose towards first-length 88A, bias-spring 82 generates an equilibrate force between contact 80 and crimp-pin 86 to further encourage actuator 84 towards first-length 88A (as indicated by arrow y); thereby urging crimp-pin 86 towards its engagement position within notch 70. Coupler 20 is now said to be in a partially closed condition in that, although crimp-pin 86 is in its engagement position, knuckle 26 will generally remain in its open position until it is engaged with a coupler-mate or if incidental contact with another object causes it pivot towards its closed position, where crimp-pin 86 will engage accordingly. As shown in FIGS. 17D and 18D, when knuckle 26 is caused to pivot towards its closed position (as indicated by arrow z), contour 72 slidingly contacts crimp-pin 86 to sufficiently compress bias-spring 82 and spring 66 to permit notch 70 to appositely engage crimp-pin 86; thereby returning coupler 20 to its entirely closed condition, as previously shown in FIGS. 17A and 18A.

It should be readily apparent that if coupler 20 is presently in its open condition, it may engage with any suitable coupling-mate. However, if it is observed that coupler 20 is presently closed, trigger signal 132 is re-activated to set knuckle 26 into its open position for engagement with a coupling-mate, as described hereinbefore.

Additional Embodiments

Figure 19:
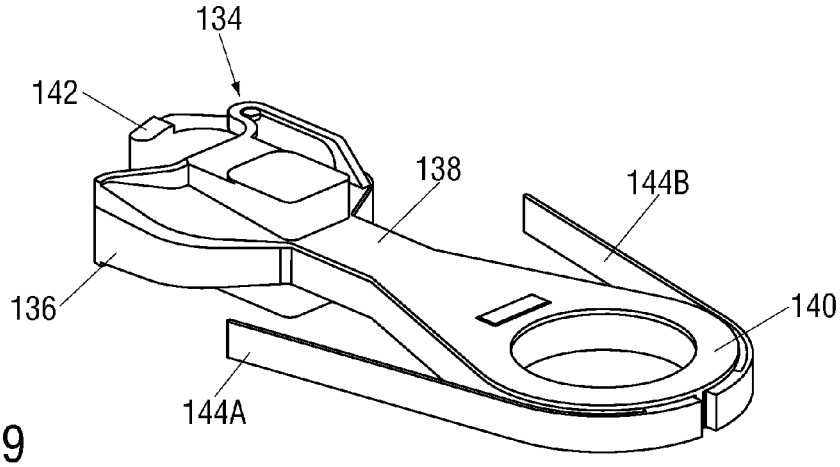
FIG. 19 is a perspective view of a coupler constructed according to a second embodiment of the present invention.

A second embodiment is illustrated in FIG. 19. A coupler 134 is desirably made of an engineering plastic and comprises a bottom member 136 and top member 138; both of which are similarly configured with respect to bottom member 34 and top member 36. Like coupler 20, coupler 134 is configured with an aperture 140 registered to receive boss 40, and thus arranged to be carried within housing 24. Further, a knuckle 142, formed similarly with respect to knuckle 26, is pivotably mounted along the distal end of coupler 134. Further still, similar to coupler 22, a locking assembly 144 is received within coupler 134 and operably similar to locking assembly 22.

According to the second embodiment, bottom member 136 is formed integrally with centering-springs 146A, 146B proximally disposed along its left and right sides. Like centering-spring 52, centering-springs 146A, 146B are operable to laterally center coupler 136 within housing 24 immediately following pivotal displacement.

CONCLUSION, RAMIFICATIONS, AND SCOPE

Accordingly, those familiar with the art will observe an accurate rendition of prototypical operation provided by a remote-controlled model railway vehicle coupling device constructed in a size easily applicable to most model railway vehicles.

Additional features and advantages of this device include:

The device comprises sub-components that are readily accessible for maintenance or replacement.

There are no parts disposed along the coupler in such a manner that may potentially interfere with the operation of a scale model vehicle or degrade its aesthetic appearance.

While the above descriptions contain many specificities, these should not be construed as limitations on the scope of the invention, but as exemplifications of the presently preferred embodiments thereof. Many other ramifications and variations are possible within the teachings of the invention.

Thus the scope of the invention should be determined by the appended claims and their legal equivalents, and not by the examples given.

I claim:

1. An improved remote-controlled model railway vehicle coupling device comprising:

a. a coupler having a shaft configured with a channel, said shaft having a proximal end and a distal end, the proximal end defining an aperture arranged for pivotably mounting along an end of a model railway vehicle, the distal end defining a head arranged for limiting the pivotable displacement of a rotatably mounted knuckle wherein said knuckle is arranged to reliably pivot between a closed position and an open closed position for engaging a similar coupler mounted along another model railway vehicle, b. a locking assembly received within said channel such that the distal end of said locking assembly is disposed adjacently to the proximal end of said knuckle, said locking assembly being electronically automated to reliably alternate between a first length and a second length, whereby said locking assembly substantially engages said knuckle in the closed position thereof during the first length of said locking assembly and, during the second length of said locking assembly, entirely disengages said knuckle to effectuate the open position thereof, c. an aperture disposed along the proximal end of said shaft to define the proximal end of said coupling device, said aperture having a cross-section substantially congruent with said shaft, said aperture designated to receive pivotable means for mounting said coupling device, d. electronic command means for remotely automating said locking assembly disposed aboard said model railway vehicle, said electronic command means being connected to said electrical contact means whereby said electronic command means are operable for both communicating a trigger signal and administering said electric current for suitable conveyance to said locking assembly;

e. a housing arranged with said pivotable means for receiving said coupling device, said housing capable of accepting singular mounting means through said pivotable means for suitable attachment to a model railway vehicle, said housing further arranged for carrying said electrical contact means whereby said electrical contact means are disposed suitably for both engaging said locking assembly, so carried within said locking assembly, and attachment to a power supply.

2. The device of claim 1 wherein said coupler comprises a bottom member and a top member each configured as corresponding elements of said coupler wherein said bottom member and said top members are cooperatingly interconnected to define the aperture, the shaft, and the head of said coupler, the shaft of said bottom member entirely having said channel arranged for substantially receiving said locking assembly therein, the proximal end of said channel arranged for entirely limiting displacement of the proximal end of said locking assembly, the central portion of said channel arranged for slidable displacement of the distal end of said locking assembly, and the distal end of said channel arranged for substantially abutting the proximal end of said knuckle, said bottom member and said top members each arranged for permitting a suitable portion of said locking assembly to partially project therethrough, whereby said electrical contact means are capable of slidably contacting said locking assembly, said bottom member and said top member each having first attachment means cooperating to secure said top member to said bottom member.

3. The device of claim 1 wherein said knuckle comprises an arm formed integrally along the proximal end thereof, said arm further formed for pivotably fitting within the distal end of said channel wherein said arm is configured for substantially engaging the distal end of said locking assembly, said knuckle further comprising rotation means operable for encouraging said knuckle towards the open position thereof whereby said rotation means is permitted to urge said knuckle towards the open position thereof when said locking assembly is operably disengaged from said knuckle.

4. The device of claim 1 wherein each of said coupler and said knuckle are made of a non-conductive material or a previously conductive material suitably rendered non-conductive through further treatment.

5. The device of claim 1 wherein said locking assembly comprises:

a) a thermo-mechanical actuator being reliably transposable between a predetermined martensite phase length when cooled and a predetermined austenite phase length when heated, wherein the martensite and austenite phase lengths thereof are configured respectively to define the first and second length of said locking assembly, said thermo-mechanical actuator being capable of using said electric current as thermal means to effectuate the austenite phase length thereof, b) a crimp arranged for receiving the proximal end of said thermo-mechanical actuator, said crimp having a lower contact-pad formed integrally along the bottom thereof such that said lower contact-pad projects downward suitably through said bottom member, c) a contact having an upper contact-pad formed integrally along the top thereof such that said upper contact-pad projects upward suitably through said top member, said contact further having a bore passing entirely therethrough, said contact further having a first plurality of snubs disposed along the distal vertical face thereof arranged for fittingly contacting the proximal end of said bias-spring, d) a tube-shaped sleeve having a distal end thereof suitable for projecting substantially through said bore, said sleeve further having a flange formed suitably along the proximal end thereof for entirely limiting convergence between said contact and said crimp, said sleeve further having a lumen arranged for passing said thermo-mechanical actuator entirely therethrough, e) a crimp-pin arranged for receiving the distal end of said thermo-mechanical actuator, said crimp-pin having a post formed along the proximal end thereof, said crimp-pin further having a second plurality of snubs disposed along the proximal vertical face thereof arranged for fittingly contacting the distal end of said bias-spring, said crimp-pin further having a distal end thereof suitable for substantially engaging said knuckle, and f) a bias-spring arranged for fitting about said sleeve and said post, said bias-spring disposed between said sleeve and said crimp-pin whereby said bias-spring is suitable for both providing an urging force against said crimp-pin for apposite engagement with said arm and encouraging said thermo-mechanical actuator towards said first length following transposition to said second length.

6. The device of claim 5 wherein each of said crimp, said contact, said crimp-pin, and said bias-spring are made of a conductive material.

7. The device of claim 5 wherein said sleeve is made of a non-conductive material whereby said sleeve is operable to insulate said crimp from said contact.

8. The device of claim 1 wherein said housing comprises a partial housing and a cover each configured as corresponding elements of said housing wherein said partial housing and said cover are cooperatingly interconnected, said partial housing and said cover each having second attachment means cooperating to secure said cover to said housing, said partial housing arranged for substantially receiving said coupler whereby a base is formed integrally with a boss disposed along the proximal end thereof for receiving said aperture and a plurality of walls disposed along the left and the right sides thereof, said partial housing and said cover each having a wiper disposed along the distal end thereof for defining said electrical contact means, said wipers formed suitably for both contacting said upper contact-pad and said lower contact-pad and projecting from said housing for attachment with said electronic command means.

9. The device of claim 8 wherein each of said partial housing and said cover are made of a non-conductive material.

10. An improved remote-controlled model railway vehicle coupling device comprising:

a coupling element;

a housing element;

a locking element being electronically automated to reliably alternate between a predetermined first length and a predetermined second length, said locking element comprising a thermomechanical actuator capable of using an electric current as thermal means to transpose between a martensite phase length and an austenite phase length wherein the martensite phase length thereof defines the second length of said locking element carried aboard said model railway vehicle; and a number of wipers operable to communicate said electric current between electronic command means and said locking element wherein said wipers are provided for establishing non-fixed contact with said locking element.

11. The device of claim 10 wherein said locking element further comprises a crimp, a sleeve, a contact, a crimp-pin, and a bias-spring; said crimp, said sleeve and said contact designated for defining the proximal end of said locking element and said bias-spring and crimp-pin designated for defining the distal end of said locking element, said crimp and said crimp-pin each having a slot designated for respectively receiving the proximal end and distal end of said thermo-mechanical actuator, said crimp and said contact each configured, respectively, with a first contact-pad and a second contact-pad formed along the bottom and top thereof for projecting suitably through said bottom member and said top member whereby said first contact-pad and second contact-pad are operable to contact said wipers for communicating said electric current thereto, said sleeve being a tube-shaped element having the distal end thereof arranged for both substantially passing through said contact and receiving the proximal end of said bias-spring, said sleeve further having a flange disposed along the proximal end thereof provided for entirely limiting contact between said crimp and said contact, said sleeve further having a lumen arranged for entirely passing said thermo-mechanical actuator therethrough, said contact further configured with a bore designated for receiving said sleeve, said crimp-pin further having the proximal end thereof arranged for receiving said bias-spring and the distal end thereof arranged for substantially engaging said knuckle, said bias-spring formed suitably along the proximal end and distal end thereof for respectively fitting about said sleeve and said crimp-pin, said bias-spring being a compression spring whereby said bias-spring is suitable for both providing an urging force against said crimp-pin for apposite engagement with said knuckle and encouraging said thermo-mechanical actuator towards the first length thereof following transposition to said second length thereof.

12. The device of claim 11 wherein each of said crimp, said sleeve, said contact, said crimp-pin, and said bias-spring are constructed of a conductive material.

13. The device of claim 10 wherein said coupling element is configured with a first outlet and a second outlet respectively disposed along the bottom member and top member thereof whereby the proximal end, especially the bottom and top, of said locking element is permitted to suitably project therethrough for contacting said wipers, said coupling element further having the channel thereof further arranged for entirely limiting displacement of the proximal end of said locking assembly, the central portion of said channel arranged for slidable displacement of the distal end of said locking assembly, and the distal end of said channel arranged for both receiving an arm, defining the proximal end of said knuckle, and the right side of said rotation means, said coupling element further comprising centering means disposed along the distal end of the bottom member thereof operable to laterally center said coupling element within said housing element following incidental rotational displacement of said coupling element, the bottom member and the top member of said coupling element each further having first attachment means cooperating to secure said top member to said bottom member.

14. The device of claim 13 wherein each of said bottom member, said top member, said centering means, and said knuckle are constructed of a non-conductive material.

15. The device of claim 10 wherein said housing element comprises a partial housing and a cover, said partial housing being cooperatingly interconnected to said cover, said partial housing and said cover each having second attachment means cooperating to secure said cover to said housing, said partial housing further having a base configured integrally with said boss, said base further having a plurality of walls formed integrally along the left and right sides thereof, said walls having a height suitable for receiving said coupling element wherein said partial housing is chiefly designated for receiving said coupling element, said partial housing and said cover each arranged for receiving said wipers.

16. The device of claim 15 wherein each of said partial housing and said cover are entirely constructed of a non-conductive material.

17. The device of claim 15 wherein said wipers are entirely constructed of a conductive material, said wipers formed suitably for both contacting said first contact-pad and said second contact-pad and projecting from said housing for attachment with said electronic command means.

18. A method of automation for uncoupling a model railway vehicle, comprising:

a) providing a model railway vehicle coupler of the type comprising a channeled shaft configured with an aperture for defining the proximal end thereof and arranged for mounting along the end of a model railway vehicle, and a head for defining the distal end thereof and arranged for limiting the rotational displacement of a knuckle, said knuckle provided for engaging a similar knuckle disposed along another model railway vehicle coupler, said knuckle being reliably rotatable between a closed position and an open position, said knuckle having rotation means operable for encouraging said knuckle towards the open position thereof, b) providing a locking assembly of the type having electronic automation, said locking assembly comprising a thermo-mechanical actuator configured with reliably transposable martensite and austenite phase lengths for respectively defining a first and a second length of said locking assembly, said locking assembly carried substantially within said shaft, the distal end of said locking assembly disposed adjacently to said knuckle whereby the first length of said locking assembly is operable to substantially lock said knuckle in the closed position thereof and, when said thermo-mechanical actuator is activated, the second length of said locking assembly is operable to free said knuckle for effectuating the open position of said knuckle, c) providing a housing of the type configured for pivotably receiving the aperture of said coupler for mounting along the end of said model railway vehicle, said housing further configured with contact means operable for conveying an electric current to said locking assembly, d) providing electronic command means for automating said locking assembly disposed aboard said model railway vehicle, said electronic command means operable for both communicating a trigger signal and administering said electric current to said locking assembly through said contact means.

* * * * *